United States Patent [19]

McQuiston et al.

[11] 4,384,656

[45] May 24, 1983

[54] TRASH RECEPTACLE HAVING LID FASTENING MEANS

[76] Inventors: William W. McQuiston, 1664 Shattuck Ave., Berkeley, Calif. 94709; Gene Davis, Rosales No. 20, Compostela, Nayarit, Mexico, 63700

[21] Appl. No.: 346,490

[22] Filed: Feb. 8, 1982

[51] Int. Cl.[3] ..... B65D 45/28

[52] U.S. Cl. ..... 220/323; 220/318; 220/1 T; 292/33

[58] Field of Search ..... 220/318, 323, 1 T; 292/33, 288, DIG. 11, DIG. 12

[56] References Cited

U.S. PATENT DOCUMENTS

| | | | |
|---|---|---|---|
| 1,773,507 | 8/1930 | Wingard et al. | 220/318 |
| 2,238,379 | 4/1941 | Tiffany | 220/323 |
| 2,632,580 | 3/1953 | Biddlecombe | 220/323 |
| 4,360,123 | 11/1982 | Blease | 220/323 |

*Primary Examiner*—George T. Hall

[57] ABSTRACT

A trash receptacle comprising an elongate can with a horizontal bottom wall and a vertical cylindrical side wall with an upper annular rim defining an open top in the can, a disc-shaped lid with an annular skirt depending therefrom and normally overlying the open top of the can. The lid has a flange radially inward of the skirt defining an annular downwardly opening channel in which said rim is normally engaged. Said upper rim is formed to define a radially outwardly projecting annular shield normally underlying and shielding the lower edge of said skirt, a radially inwardly disposed annular stop surface spaced radially outward from said flange and a downwardly disposed annular stop shoulder above said stop surface. The receptacle next includes a plurality of elongate radially extending circumferentially spaced bolts shiftably carried by said flange for free radial movement from a normal outer locked position where they extend below said stop shoulder and engage said stop surface to an inner open position where they are disengaged from below said stop shoulders. Manually operable means is to selectively shift the bolts between their locked and open positions and includes a manually engageable rotatable handle at the top of the lid, crank means below the lid and drivingly connected with the handle and substantially radially extending rods connected with and between the crank means and the bolts.

8 Claims, 9 Drawing Figures

TRASH RECEPTACLE HAVING LID FASTENING MEANS

This invention has to do with a trash can and is particularly concerned with a trash can having novel means to prevent animals from gaining access to the interior thereof.

BACKGROUND OF THE INVENTION

The long established and common use of trash and/or garbage cans is so familiar to the general public that explanation of the purpose, function and use of such cans need not be entered into.

It should be noted that most trash and garbage cans have flat, horizontal bottom walls and cylindrical side walls projecting upwardly from the bottom walls and defining open tops. The great majority of such cans are provided with substantially flat, horizontal lids or covers removably engageable over the open tops of the cans. The covers characteristically include annular depending peripheral retaining flanges or skirts which depend about the exterior of the upper portions of the side walls of their related cans and are provided with central manually engageable handles at their tops, to facilitate manual manipulation thereof.

Due to the various support means and/or systems commonly utilized to accommodate and effect the use and handling of trash and garbage cans, such cans have become substantially standardized as regards their basic size, shape and construction. Standardizing of such cans has become sufficiently well established so that many municipalities have adopted codes which specify and require the use of particular sizes and models of trash and garbage cans.

While common trash cans have proven to be reasonably satisfactory for use in most situations, there are a number of commonly encountered situations where they are notably deficient. One well known and common situation where trash cans are deficient is where domestic and/or wild animals are present and can gain substantially free access to such cans while foraging for food. In such situations, ordinary trash can lids are so insecure that substantially any animal seeking entry into their related cans can quickly and easily displace the lids. In those cases where trash can lids are secured in place by common bail-like latch means and/or where they frictionally engage their related cans so that they are not freely removable, animals generally learn to release the commonly provided forms of latch means and thereafter pry the lids free. In many instances, large animals, such as dogs and bears, simply and directly knock trash cans over with sufficient force to displace the lids and to scatter the contents of the cans for convenient foraging.

It has been conservatively estimated that in the United States, each day animals gain access to and frequently scatter the contents of millions of trash cans.

As a result of the foregoing, there has been a long felt need for effective and convenient to operate means for releasably securing trash can lids on their related cans to prevent displacement thereof by animals and thereby eliminate the inconveniences and hazards otherwise caused by animals.

The prior art is repleat with various forms and kinds of manually operable latching or locking means to releasably secure trash can lids to their related cans, but to date, no such means has met with notable commercial success and, to the best of our knowledge, no such means is presently being produced and made available to the general public.

OBJECTS AND FEATURES OF OUR INVENTION

It is an object of our invention to provide novel locking means to effectively secure a trash can with a related lid against entry by animals.

It is another object of our invention to provide a locking means for attaining the above noted end which is easy and economical to manufacture, easy and convenient to use and which is highly effective and dependable in operation.

It is an object and feature of the present invention to provide a locking means to releasably secure a trash can lid in closed engagement over and about the upper open end of a related trash can and which includes a manually rotatable crank means carried by the lid, and a plurality of circumferentially spaced bolts carried by the lid and operatively connected with the crank means, whereby the bolts are moved radially inwardly and outwardly out of and into locked engagement with a part of the trash can upon manual rotation of the crank means.

It is another object and feature of the present invention to provide a lock means of the character referred to above wherein the bolts are connected with the crank means by elongate rods and the trash can has a radially inwardly disposed stop surface normally engaged by the bolts and an annular downwardly disposed stop shoulder, beneath which the bolts normally extend.

Another object and feature of our invention is to provide a lock means of the character referred to above wherein the rods connected with and between the bolts and crank means are moved over dead center relative to the rotative axis of the crank means when the lock means is moved to its locked position, whereby the lock means is normally yieldingly held in said locked position.

It is another object and feature of our invention to provide a locking means of the character referred to above wherein the lid has an annular skirt depending from its outer periphery and about the upper exterior portion of the can and wherein said can has a portion equal to or greater in outside diametric extent and occurring immediately below the lower edge of the skirt to shield said lower edge and prevent animals from engaging their claws below said edge and effect lifting or prying the lid free from the can.

Still another object and feature of our invention is to provide a can and lid assembly or structure of the general character referred to above wherein the lid has an annular downwardly opening groove in which the rim portion of the can is normally engaged and in which a sealing ring is set to seal with and between the can and the lid to prevent the free escape of odors from the can which might otherwise attract animals.

It is an object and feature of the invention to provide a structure of the general character referred to above which includes a novel manually engageable operating handle for the lid and the crank means which handle is accessible at the top of the lid.

Another object and feature of our invention is to provide a structure of the general character referred to in the foregoing which includes an annular adapter ring to cooperatively engage with the lid and with parts of the locking means and which is secured to and about the upper open end of a standard trash can or to and about the upper open end portion of a standard metal drum or the like to convert that drum into a trash can.

An object and feature of our invention is to provide an adapter ring of the character referred to above which functions to reinforce its related can or drum to prevent deformation and/or damage thereto by animals and to enhance the ability of the resulting structure to withstand the abuse to which trash cans are normally subjected.

Finally, it is an object and feature of our invention to provide a trash can structure of the general character referred to above which further includes novel anchoring means to releasably secure the bottom of the can to a related support platform or structure to maintain the can in an upright position and prevent it from being upset or turned over by animals seeking to gain entry thereto.

The foregoing and other objects and features of our invention will be fully understood from the following detailed description of typical preferred form and/or embodiments of our invention, throughout which description reference is made to the accompanying drawings.

DESCRIPTION OF THE INVENTION

Figure 1:
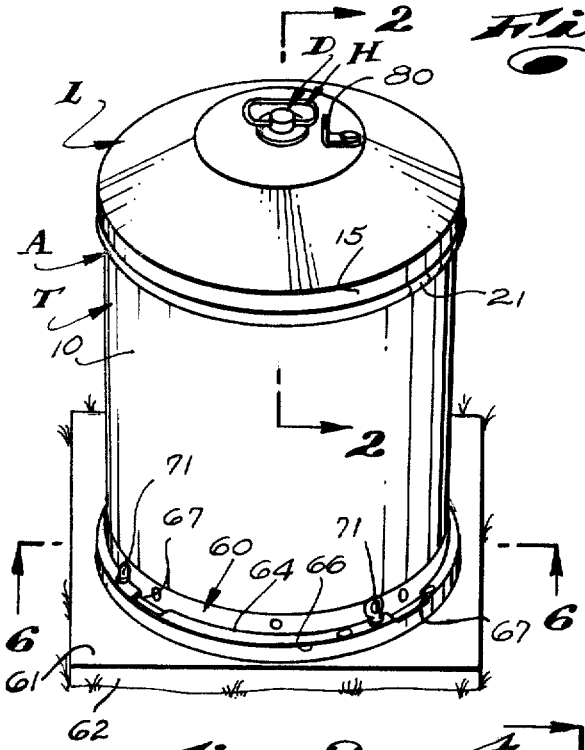
FIG. 1 is an isometric view of a trash can and trash can lid assembly embodying our invention.
Figure 3:
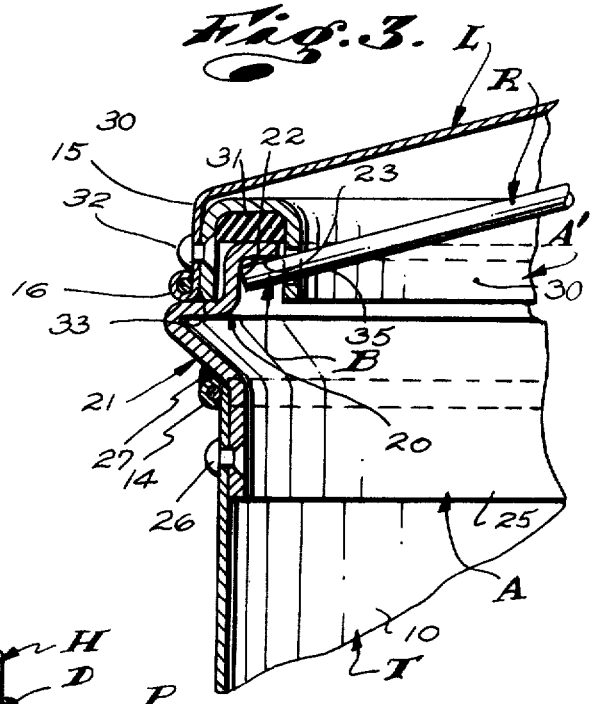
FIG. 3 is an enlarged detailed sectional view of a portion of a structure shown in FIG. 2.
Figure 2:
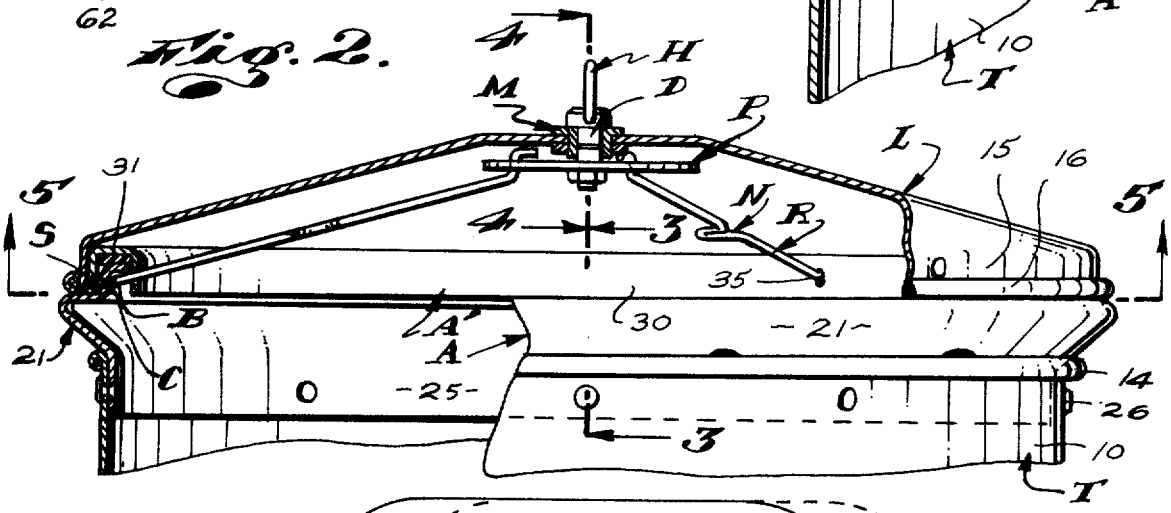
FIG. 2 is an enlarged sectional view taken substantially as indicated by line 2—2 on FIG. 1.
Figure 4:
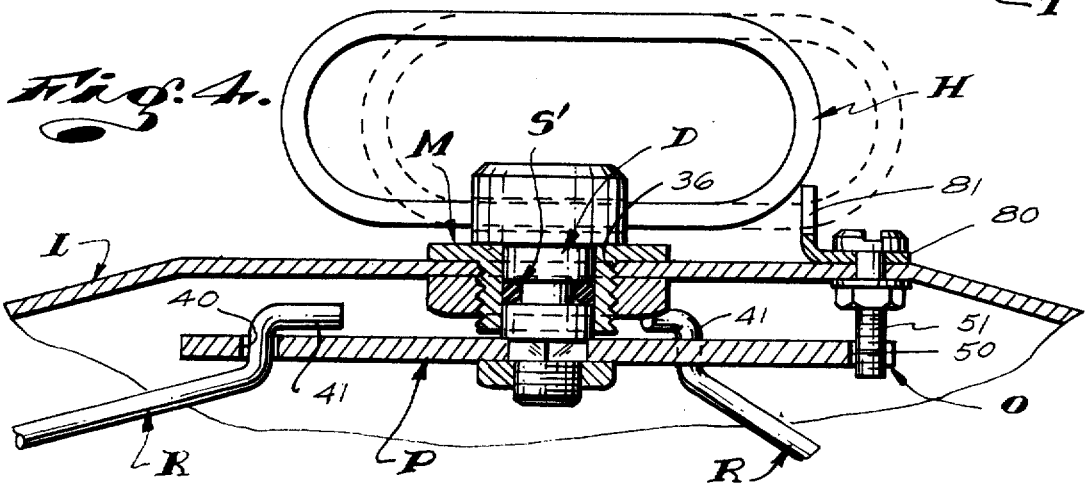
FIG. 4 is an enlarged detailed sectional view taken substantially as indicated by line 4—4 on FIG. 2.

In FIGS. 1 through 6 of the drawings, we have elected to illustrate a preferred form and carrying out of our invention wherein the common or standard trash can T and a related common or standard trash can lid L are utilized and wherein the novel aspects and features of our invention are embodied in and/or with the can and lid by adapter parts which can, if desired, be produced and marketed as an adapter kit. By providing such an adapter kit or kits, it is possible and/or practical to embody our invention in many standard commercially available trash cans and to modify and/or convert other common containers, such as standard oil drums and the like, into trash cans.

The trash can T shown in the drawings is a common sheet metal unit having a vertical cylindrical side wall 10 and a flat, horizontal bottom wall 11. The side and bottom walls 10 and 11 are joined by an annular rolled seam structure defining an annular and downwardly projecting annular lower flange-like bead 12 about the bottom of the can. The open top of the can is defined by a roll-formed radially outwardy projecting annular upper or top bead 14.

The lid L is a substantially flat horizontal disc-like sheet metal unit which is slightly greater in diametric extent than the upper open end of the can and has an annular, vertical, retaining skirt 15 about and depending from its outer perimeter to normally freely or slidably engage about the bead 14 at the upper open end of the can. The lower annular edge of the skirt 15 is roll-formed to establish an annular radially outwardly projecting bead 16. In practice, the lid L can be flat or can, as shown, be made conical or convex to impart into it desired structural stiffness and/or rigidity.

The can structure illustrated and described above is typical of most standard makes and models of metal trash cans and is similar in construction with common metal drums, such as grese drums. The lid structure disclosed and briefly described above is also typical of most common or standard metal trash can lids and is similar to those lids which are most easily and commonly made for use in connection with metal grease drums and the like when such drums are put to use as trash receptacles.

An extremely serious shortcoming found to exist in ordinary, commercially available, metal trash can and trash can lids of the character disclosed above resides in the fact that they are not sufficiently rigid and/or strong to withstand the abuse to which they are ordinarily subjected and are such that the upper open ends of the cans are easily deformed and/or bent to such an extent that the lids cannot be effectively engaged therewith and to such an extent that the cans are rendered unserviceable.

In such can structures, once their rim portions are bent or deformed, their structural integrity is upset to such an extent that the remaining parts and/or portions thereof are seriously weakened and are soon bent, collapsed and/or mutilated during their normal subsequent use.

It has been determined and is believed apparent that if the upper rim portion of a trash can, such as noted above, was effectively reinforced to prevent its being bent and/or otherwise deformed, the structural integrity of the can would be preserved and its useful life would be greatly extended.

In furtherance of our invention, we provide an annular roll formed adapter ring A of heavy gauge hardened steel, engaged in and fixed with the upper open end portion of the trash can T to reinforce that portion of the can. The ring A is formed to define an upwardly projecting annular retaining flange 20 and a radially outwardly annular shielding flange 21. The flanges 20 and 21 cooperate to define an upwardly and radially outwardly opening annular seat S to normally accommodate the lower edge portion of the skirt 15 of the lid L. The flange 20 occurs radially inward of the skirt 15 to orient the lid and prevent radial displacement thereof, while the flange 21 underlies and normally engages the lower edge of the skirt 15 and/or the bead 16 about the lower edge thereof and prevents animals from engaging their claws beneath the lower edge of the skirt and thereby effect lifting or prying the lid from engagement with the can.

The adapter ring A is further formed to establish an annular radially inwardly disposed stop surface 22 and a downwardly disposed annular stop shoulder 23 above and radially inward of the stop surface 22. The stop surface 22 and stop shoulder 23 are provided to cooperatively engage radially shiftable retaining parts or bolts carried by the lid L, which will hereinafter be described.

In the form of the invention illustrated, the adapter ring has a vertically extending cylindrical lower portion 25 slidably engaged in the upper portion of the can T and fixed thereto by a plurality of circumferentially spaced radially extending rivets 26 and/or spaced welds 27. The ring A next has a radially outwardly and upwardly inclined and thence radially inwardly turned intermediate portion defining the above referred to shielding flange 21. The downwardly and radially outwardly disposed inclined portion of the flange 21 presents a surface which cannot be effectively engaged by and which effectively deflects the claws of animals which might otherwise be engaged with and beneath the flange 15 of the lid and enable the animals to disengage the lid from the can.

The ring A next has a vertically turned upwardly projecting annular flange-like portion about the upper inner edge of the intermediate portion and which defines the above noted orienting and/or retaining flange 20 of the ring. The inside surface of the upper flange-like portion defines the stop surface 22. The ring A next and finally includes a radially inwardly turned and extending annular lip formed on and about the upper edge of the upper flange-like portion. The annular lip defines the downwardly disposed annular stop shoulder 23. The lip also defines a flat upwardly disposed annular sealing surface at the top of and about the flange 20.

It will be apparent that the roll-formed hard steel adapter ring A described above and shown in the drawings is an easy and economical to make, inherently strong and durable part which, when engaged in and fixed with the upper open end portion of the can T, reinforces the can and cooperates therewith to establish an exceedingly strong and durable structure which will not bend, collapse or deform when subjected to the work and environment to which the can structure is likely to be subjected.

It is to be noted that the ring A can be engaged in and fixed with the upper open end of the paper or molded plastic trash can or similar container and is such that it will serve to reinforce and strengthen such cans and containers in the same way and/or manner that it reinforces the can T in the form of the invention illustrated.

In furtherance of our invention, the lid L is provided with an inner annular vertical flange 30 spaced radially inward of the skirt 15 and cooperating therewith to define an annular downwardly opening channel C in which the orienting and retaining flange 20 of the adapter ring A is normally freely engaged.

In the preferred carrying out of the invention, an annular resilient sealing ring 31 is seated within the top of the channel C to engage and seal with the upper edge of the retaining flange 20 or with the sealing surface defined by the lip on that flange illustrated in the drawings and described above.

In the case illustrated, the channel C is defined by an annular downwardly opening roll formed metal adapter ring A', arranged in seated engagement below the lid L and inward of the skirt 15. The ring A' is fixed in and with the lid by rivets 32 and/or welds 33, substantially as shown.

Provision and use of the adapter ring A' is desired since it is an easy and economical to make and use part and serves to reinforce the lid L so that it will withstand great abuse without becoming deformed or otherwise mutilated to an extent that it cannot be put to its intended use.

It is to be particularly noted that the rings A and A' are normally interengaged in such a manner that each supplements the other to reinforce the asembly of parts and that the rings, together, establish an exceedingly strong and durable construction.

Figure 5:
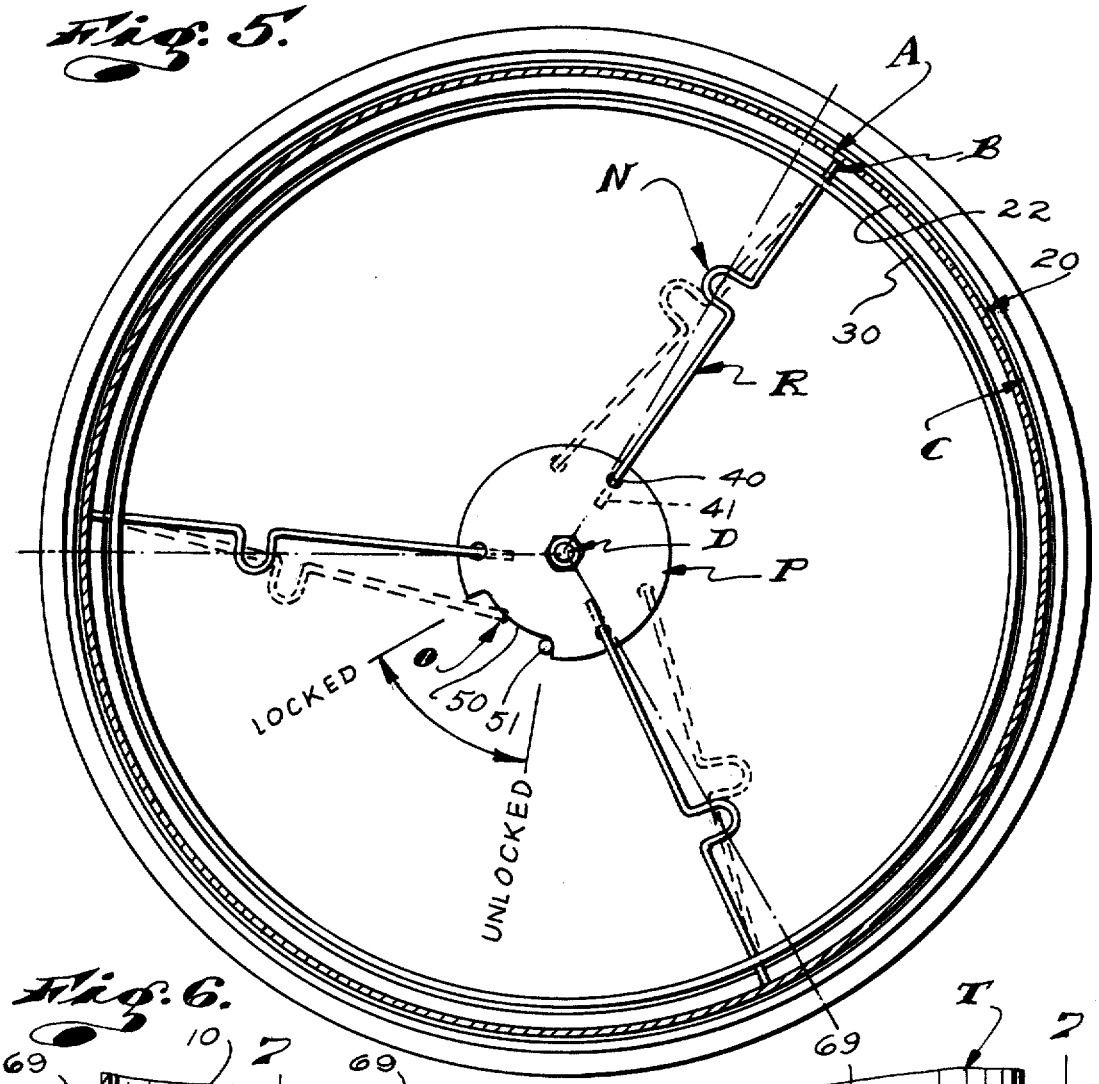
FIG. 5 is a sectional view taken substantially as indicated by line 5—5 on FIG. 2.

In furtherance of our invention, the flange 30 of the ring A' carries a plurality of circumferentially spaced radially extending lock pins or bolts B shiftable radially to normally extend below the stop shoulder 23 of the ring A and to thereby lock the cover in closed engagement about and over the ring A and which can be shifted radially outwardly from beneath the shoulder 23 to release the lid L for free manual vertical movement and displacement relative to the ring A. In the preferred carrying out of the invention and as best shown in FIG. 5 of the drawings, there are three bolts B spaced 120° one from the other and slidably engaged in and through radial openings 35 provided in the flange 30.

The bolts B are defined or established by the outer end portions of three circumferentially spaced, elongate, normally substantially radially extending rods R, arranged below the lid L within the confines of the flange 15 thereof.

The rods R have inner ends terminating radially outward from the central vertical axis of the lid and which are pivotally coupled with a central disc-like crank plate P. The crank plate P is concentric with the central vertical axis of the lid and is drivingly engaged on and carried by a vertical drive shaft D rotatably engaged in and projecting vertically and upwardly through a bore in a bearing structure M engaged through and set in an opening 36 established in the center of the lid L. The bearing structure M, shaft D and crank plate P are such that the shaft and plate are free to rotate and are stopped from vertical movement relative to the lid.

In the case illustrated, the shaft B carries an O-ring seal S. The seal S seals between the shaft and the means M. The seal S, together with the seal 31 noted above, effectively seals the can structure and prevents the escape of odors which might otherwise attract animals.

The crank plate P has three definable quadrant portions, each related to the inner end of one rod R, and which constitute a crank for moving its related rod upon rotation of the drive shaft and plate relative to the lid.

The inner ends of the rods R can be pivotally connected or coupled with their related crank portions of the plate in any desired and suitable manner. In the case illustrated, the outer ends of the noted quadrant portions of the plate are provided with vertical through openings 40 and the inner ends of the rods are formed with vertically turned and thence radially extending, vertically offset, inner end portions 41 which extend through related openings 40 in the plate to establish pivotal hooked and driving engagement with the plate, as clearly shown in FIG. 4 of the drawings.

In practice, and as shown in the drawings, the outer ends of the bolts B normally engage and stop against the stop surface 22 defined by the ring A. The effective length of the rods R and bolts B is slightly greater than the distance between the stop surface 22 and the pivotal axes between the rods and the crank plate P whereby the rods resist rotary movement of the crank plate through that arc of travel which moves the axis of the rods over dead center with respect to the central rotary axis of the plate. To allow or permit rotation of the plate and movement of the rods over dead center, the rods are formed to yieldingly bend and shorten upon the directing of compressive forces longitudinally therethrough. In the case illustrated, the central portions of the rods R are formed with laterally outwardly and thence inwardly turned U-shaped or loop-type spring portions N which allow for desired axial shortening of the rods. In practice, the rods might be made sufficiently light and flexible to deflect laterally relative to their normal central axes when compressed axially, thereby eliminating need of the means N. In such a case, the rods themselves establish a spring means which is functionally similar to the spring means N.

In addition the foregoing, a stop means O is provided to limit and stop rotation of the plate P between an actuated or locked position where the bolts B are stopped against the stop surface 22 and the spring means N of the rods are biased to hold the bolts engaged with said stop surface and to a released position where the rods are moved circumferentially and radially inward to shift the bolts B radially inward and from below the stop shoulder 23 and to that position where their outer end portions are within the openings 35 in the flange 30. The stop means O can vary widely in practice and is shown as including an elongate arcuate, vertically and radially outwardly opening notch 50 with circumferentially spaced and opposing ends in the periphery of the plate P and the vertical stop pin 51 carried by the lid L and depending into and through the notch 50 and engageable with the ends thereof. The notch 50 is that when the plate is turned from one to the other of its two positions, it moves the inner ends of the rods circumferentially over dead center and so that when the construction is in its normal locked position, the noted spring means N are biased and yieldingly hold the structure in that position.

In operation, when the circumferentially spaced bolts B are moved into engagement with their related stop surface 23 of the adapter ring A and as the rods and/or spring means yield, the rods operate to move and orient the lid L into concentric position over and with the can and thereafter serves to yieldingly prevent radial shifting and/or movement therebetween.

The structure that we provide next includes a suitable handle H on or coupled with the upper end of the drive shaft D. The handle is accessible at the top center of the lid L. The handle H can be engaged with one hand to rotate the shaft and release and/or lock the lid with the can and move the lid into and out of engagement with the can, as desired and as circumstances require. In the case illustrated, the handle H is a simple manually engageable loop or bail-like handle with an upper hand-engaging portion and a lower portion engaged through an opening in the upper end portion of the shaft which projects up from the center of the lid L. The handle is such that it can be freely pivoted about the axis of the opening in the shaft and is such that it establishes rotary driving engagement with the shaft upon its being turned circumferentially relative to the axis of the shaft.

In practice, the adapter ring A can be eliminated by suitabley roll-forming or molding the upper end portion of the can to define those same parts, portions and/or features which characterize the ring A. The adapter ring A' related to the lid L can be eliminated by suitably roll-forming, pressing and/or molding the lid L so as to form the lid with those same parts, portions or features which characterize the ring A' and which are necessary for carrying out our invention.

Figure 6:
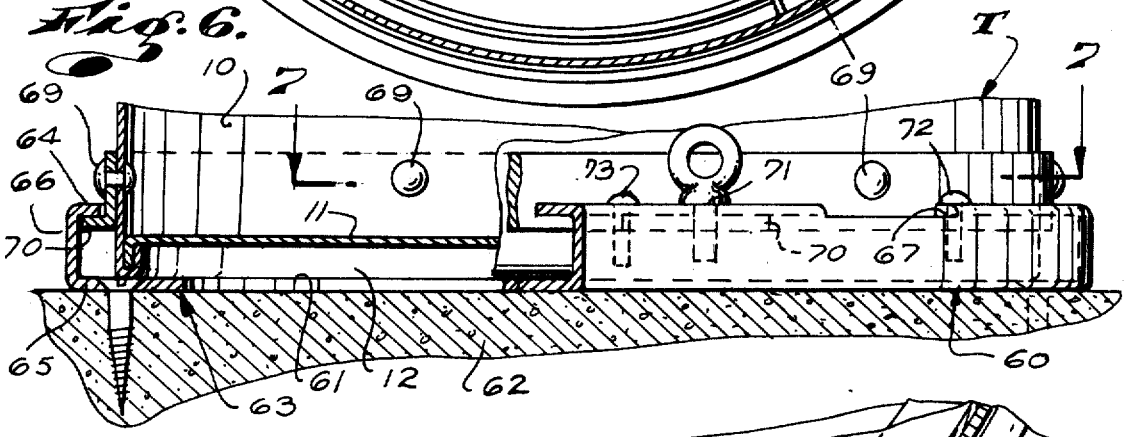
FIG. 6 is a view taken substantially as indicated by line 6—6 on FIG. 1.
Figure 7:
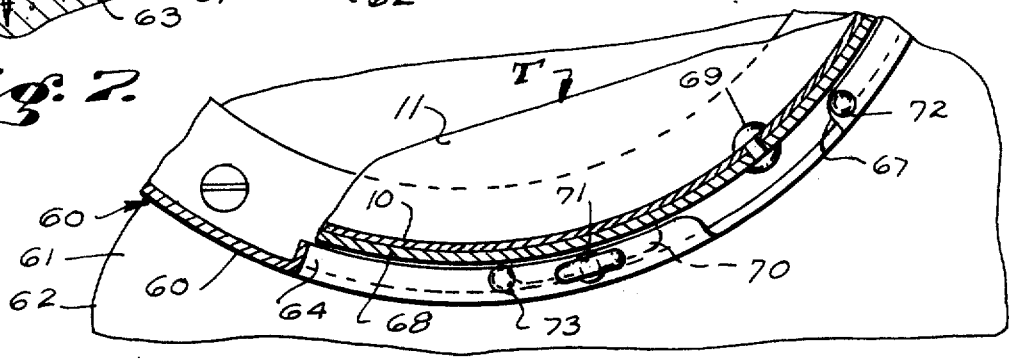
FIG. 7 is a view taken substantially as indicated by line 7—7 on FIG. 6.
Figure 8:
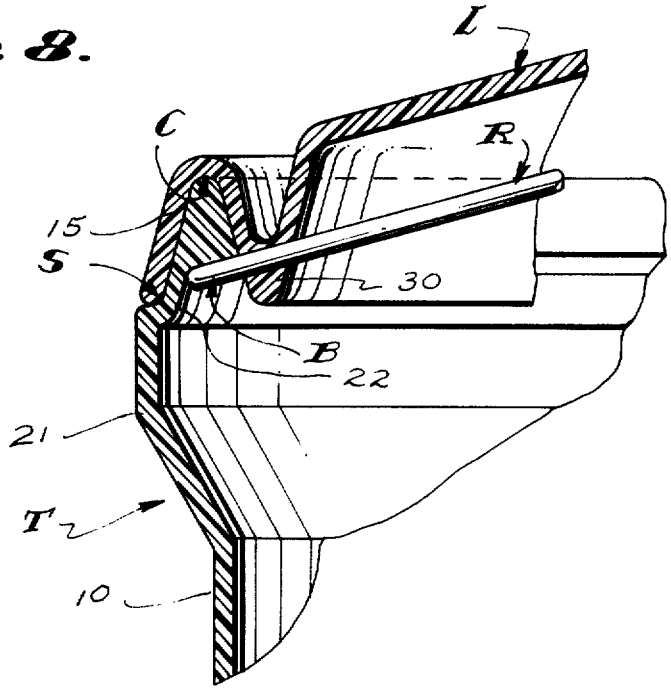
FIG. 8 is a view similar to FIG. 3 showing another form of the invention.
Figure 9:
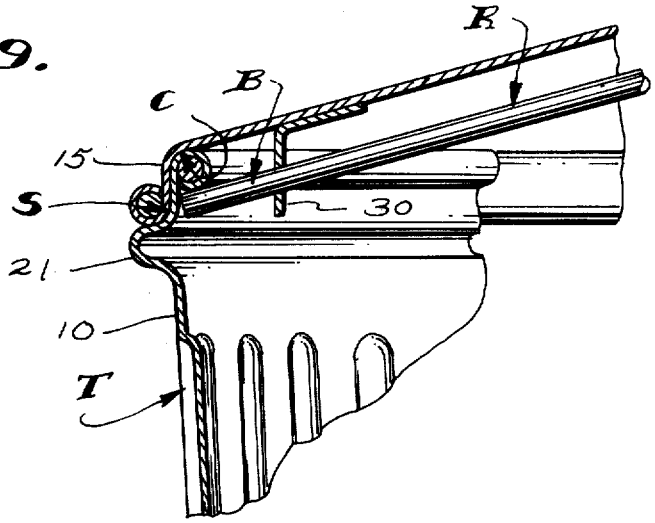
FIG. 9 is a view similar to FIG. 3 showing yet another form of the invention.

In FIGS. 8 and 9 of the drawings, we have shown typical modifications or changes that might be made and practiced in carrying out our invention and in which the reference characters and numerals used to identify parts and portions of the invention are the same as those used to identify like parts and portions of the structure illustrated in FIGS. 1 through 7 of the drawings.

Further, the details of construction of the crank plate P, shaft D, bearing means M, stop means O and/or handle H can be modified or changed substantially without departing from the broader aspects of our invention.

In addition to the foregoing and supplementing the novel aspects and features of our invention described in the foregoing and as shown in FIGS. 1, 6 and 7 of the drawings, we provide novel anchoring means 60 to releasably secure the bottom of the can T to the top surface 61 of a deck or platform 62 and to thereby prevent the can from being moved and/or tipped over by animals seeking to break into the can. The means 60 includes an annular ring-like anchoring plate 63 screw-fastened or otherwise fixed to the top 61 of a platform 62. The plate 63 is U-shaped in cross-section and has top, bottom and outside walls or flanges 64, 65 and 66. The noted walls or flanges cooperate to define an annular radially inwardly opening channel. The top flange 64 is formed or provided with a plurality (for example, four), circumferentially spaced elongate, circumferentially extending vertically and radially inwardly opening notches 67.

The means 60 next includes an annular band or ring 68 of strap steel engaged about the exterior or the side walls 10 of the can T at the bottom end portion thereof. The ring 68 is fixed to the can by means of rivet fasteners 69 or can be welded thereto. The ring 68 is formed with a plurality (for example, four) of circumferentially spaced elongate circumferentially extending radially inwardly projecting retaining blades 70. The blades 70 are slightly less in circumferential and radial extent than the notches 67 and are such that upon arranging the can T above the ring and rotating the can, the blades can be moved circumferentially into and out of register with the notches. When the blades are registered with the notches, the can drops down into engagement within the plate. Thereafter, upon rotating the can and moving the blades out of register with the notches, the blades move into captive engagement in the channel defined by the plate and the can is securely locked in place atop the platform.

In practice, the top flange 64 of the plate and at least one of the blades 70 are provided with vertical openings which register when the flanges are moved out of register with the notches a predetermined distance. A suitable lock pin 71 (eye bolt) accessible at the top of the flange 64 is engageable in the registering openings to releasably lock the plate and the ring against relative rotation.

To assist in orienting the openings for the pin 71, stop pins 72 and 73 are carried by the flange 64 and depend into the channel defined by the plate to engage and limit movement of the blades circumferentially in the channel. The pin 72 occurs near one end of a related notch 67 to limit or restrict movement of the blades 70 circumferentially toward the other end of the notch. The pin 73 occurs in spaced relationship from said other end of the notch a distance equal to that distance the blades must be moved to effect register of the lock pin receiving openings in the top flange 54 and blades.

In practice, the notches 67 and blades 70 need only be a few inches long and extend circumferentially 10° to 15° to afford adequate engagement and support. Accordingly, they need only be turned a short distance, for example 20°, to effect engagement and disengagement of the anchoring means 60.

It is to be noted that the anchoring ring engaged about the bottom of the can effectively reinforces that end of the can and eliminates the likelihood that the can might be bent and sprung in such a manner as to release the anchoring means by laterally applied forces on and through the can.

In some instances, where bears are encountered, provision and use of the above noted anchoring means, in combination with the novel lid structure and locking means that we provide, is necessary or advisable since bears will tip trash cans over and, with their great weight and force, rupture the sides of the trash cans open (if access through the tops of the cans is thwarted). If the cans cannot be tipped over to expose their fragile side walls in a manner which enables bears to effectively apply their weight thereto, the ability of the bears to rupture and gain entry through the side walls of the cans is effectively thwarted.

In addition to the foregoing, the bail lock handle H is such that its lower portion is axially shiftable in the opening in the shaft B through which it extends. Accordingly, the handle H can be shifted radially outward relative to the shaft a limited distance. The lid L is provided with and carries an upwardly projecting sheet metal cleat 80 with an upwardly opening notch 81 into which an outer lower end portion of the handle H can be moved into engagement, to effectively releasably lock the handle against rotation relative to the lid, by manually shifting the handle radially outward relative to the shaft B.

It will be apparent from the foregoing that our invention provides a novel, effective and convenient to operate trash can structure which is such that access to the interior thereof and to materials deposited by animals therein, is effectively prevented when the lid is engaged over and releasably locked to the top of the can. It will be further apparent that our invention is easy and economical to make and can be formed and built into a can structure and its related lid as an integral part or can be applied to and incorporated in and with standard trash can and lid structures by the provision of simple, economical to make, and easy to install adapter rings and parts.

Having described only tupical preferred forms and embodiments of our invention, we do not wish to be limited to the specific details herein set forth but wish to reserve to ourselves any modifications and/or variations that might appear to those skilled in the art to which our invention pertains and which fall within the scope of the following claims:

Having described our invention, we claim:

1. A trash can and lid assembly comprising an elongate can structure with a horizontal bottom wall and an elongate vertical cylindrical side wall projecting upwardly from the bottom wall and having an upper annular rim portion defining an open top in the can, a substantially flat horizontal disc-shaped lid normally overlying the open top of the can and having an annular skirt depending therefrom and about the exterior of said upper rim portion, said lid has a flange radially inward of the skirt defining an annular downwardly opening channel in which an upper portion of said rim portion is normally engaged, said upper rim portion has a radially outwardly projecting annular shield normally underlying and shielding the lower edge of said skirt, a radially inwardly disposed annular stop surface normally spaced radially outward from the flange of the lid and a downwardly disposed annular stop shoulder above said stop surface and radially outward of the flange of the lid, a plurality of elongate radially extending circumferentially spaced bolts shiftably carried by the flange of the lid for free radial movement from a normal outer locked position where they extend from the flange of the lid below said stop shoulder and engage said stop surface to an inner open position where they are disengaged from the stop surface and moved from below said stop shoulders and manually operable means to selectively shift the bolts between their locked and open positions and including a manually engageable rotatable handle at the top of the lid, crank means below the lid and drivingly connected with the handle and substantially radially extending rods connected with and between the crank means and the bolts.

2. The trash can and lid assembly set forth in claim 1 wherein said upper annular rim portion is an annular ring of roll-formed steel with a lower portion concentric and positioned radially adjacent an upper portion of said side wall and fastened thereto.

3. The trash can and lid assembly set forth in claim 2 which includes an annular downwardly opening channel part with inner and outer flanges positioned beneath the cover with its outer flange adjacent to and reinforcing said skirt and its inner flange defining said flange of the lid and cooperating with said skirt and outer flange to define said channel of the lid.

4. The trash can and lid assembly set forth in claim 1 which includes an annular downwardly opening channel part with inner and outer flanges positioned beneath the cover with its outer flange adjacent to and reinforcing said skirt and its inner flange defining said flange of the lid and cooperating with said skirt and outer flange to define said channel of the lid.

5. The trash can and lid assembly set forth in each of claims 1, 2, 3 or 4 wherein there are three bolts and rods spaced 120° one from the other and wherein the bolts move and hold the lid concentric with the can when moved to their normal locked position and engage said stop surface.

6. The trash can and lid assembly set forth in each of claims 1, 2, 3 or 4 which further includes stop means to limit rotation of the cam means between its open and closed positions and which includes a stop pin in fixed position relative to the lid and circumferentially spaced stops on said cam means and engageable with said stop pin.

7. The trash can and lid assembly set forth in each of claims 1, 2, 3 or 4 which further includes stop means to limit rotation of the cam means between its open and closed positions and which includes a stop pin in fixed position relative to the lid and circumferentially spaced stops on said cam means and engageable with said stop pin, said cam means moves the axes of the rod past dead center relative to the axis of the cam means when the cam means is moved between its locked and unlocked positions, said rods are normally greater in longitudinal extent that the distance between the cam means and the bolts when the cam means and bolts are in their locked position and the longitudinal axes of the rods extend to one side and are out of dead center alignment with the axis of the crank means, said rods are normally yieldingly biased between the crank means and the bolts.

8. The trash can and lid assembly set forth in each of claims 1, 2, 3, 4, 5, 6, 7 or 8 which further includes a platform beneath and supporting the cam and anchoring means releasably securing the bottom of the cam on the platform in set vertical position, said anchoring means includes an anchoring plate fixed to the platform, an anchoring ring fixed to and extending about the bottom of the cam and normally engaged atop the plate, a plurality of circumferentially spaced circumferentially extending elongate radially inwardly and circumferentially opening bayonet slots on the anchor plate positioned radially outward of the anchor ring and a plurality of circumferentially spaced radially outwardly projecting bayonet blades on the anchor ring slidably engaged in the bayonet slots, stop means closing one of the ends of at least one bayonet slot and engaging a related one end of the bayonet blade engaged in that slot and retaining means removably engaged in the other end of at least one of the bayonet slots and releasably engaging the other end of the bayonet blade engaged in that slot.

* * * * *